United States Patent [19]

Molina

[11] 4,402,203

[45] Sep. 6, 1983

[54] FASTENER INSTALLATION TOOL

[75] Inventor: Jorge W. Molina, Torrance, Calif.

[73] Assignee: Deutsch Fastener Corp., El Segundo, Calif.

[21] Appl. No.: 400,880

[22] Filed: Jul. 22, 1982

[51] Int. Cl.[3] ..... B21J 15/34

[52] U.S. Cl. ..... 72/114

[58] Field of Search ..... 72/114, 391, 454

[56] References Cited

U.S. PATENT DOCUMENTS

| | | | |
|---|---|---|---|
| Re. 27,978 | 4/1974 | Gulistan | 29/400 |
| 2,641,378 | 6/1953 | Wilt | 72/391 |
| 3,263,466 | 8/1966 | Shackelford | 72/114 |
| 3,587,271 | 6/1971 | Rigot | 72/114 |
| 3,686,914 | 8/1972 | Powsey | 72/114 |
| 3,695,324 | 10/1972 | Gulistan | 411/111 |
| 3,861,185 | 1/1975 | Maddox | 72/114 |
| 3,933,019 | 1/1976 | Underland | 72/114 |
| 4,121,444 | 10/1978 | Duran | 72/114 |

*Primary Examiner*—Gene Crosby

*Attorney, Agent, or Firm*—Gausewitz, Carr, Rothenberg & Edwards

[57] ABSTRACT

This invention provides an installation tool for a fastener that includes a nut and a tubular portion having an external knurl, the tool including an internally and externally threaded sleeve, a screw extending through the sleeve and engageable with the nut of the fastener, and an internally threaded element engaging the external threads of the sleeve and having an abutment surface at one end. Advancement of the internally threaded element causes the screw to move the fastener axially, forcing its tubular portion into an opening in a workpiece. The sleeve has a die surface at one end and is then advanced to engage the end of the tubular portion of the fastener for bending it outwardly to form a flange.

8 Claims, 5 Drawing Figures

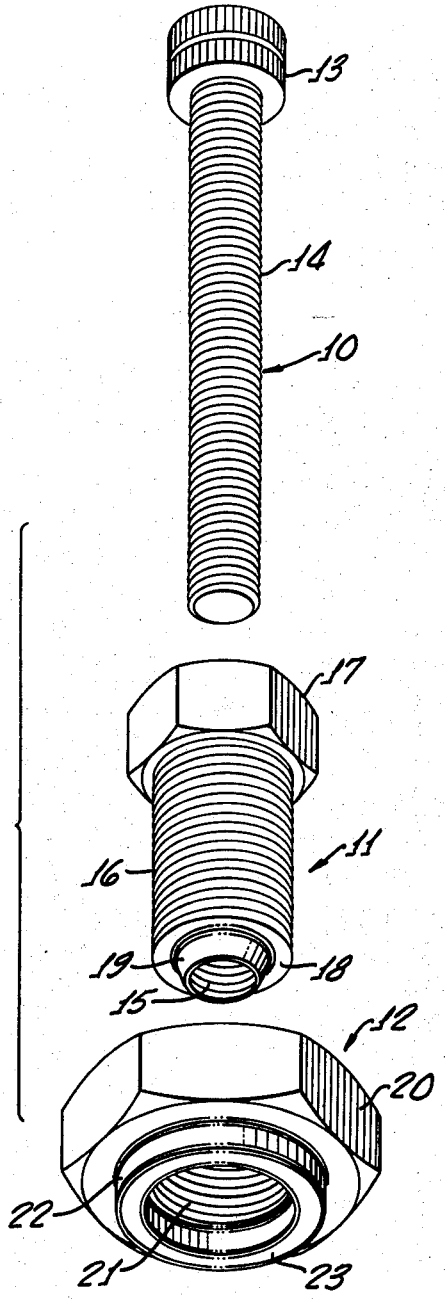
FIG. 1.
FIG. 2.
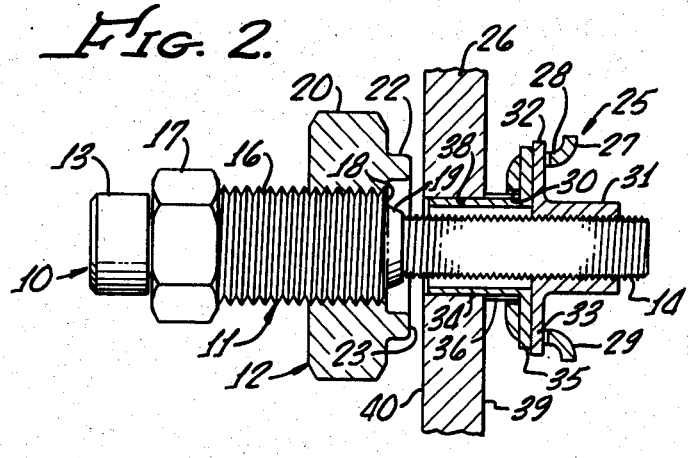
FIG. 3.
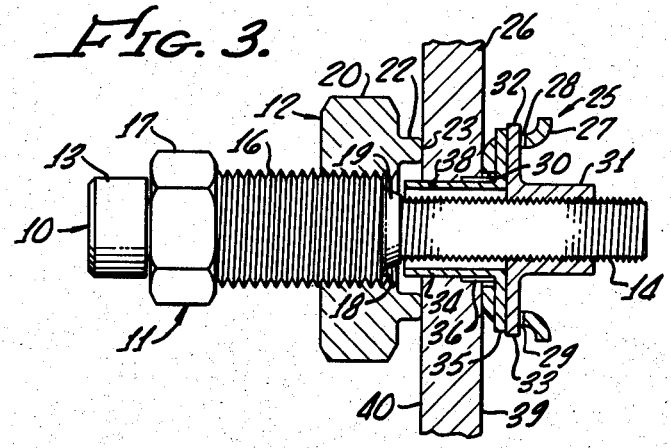
FIG. 4.
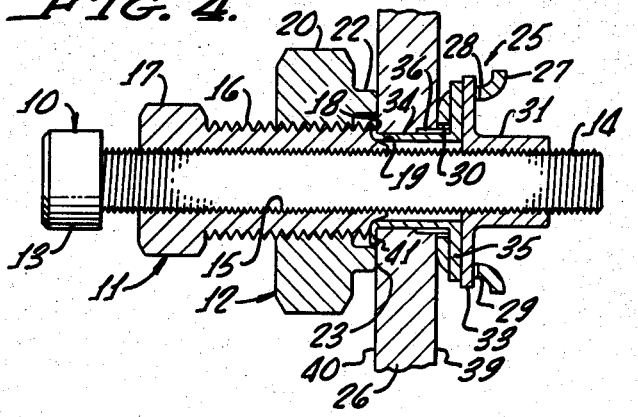
FIG. 5.
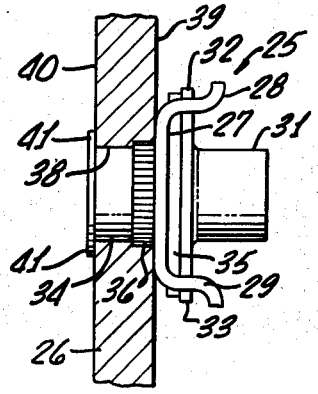

FASTENER INSTALLATION TOOL

BACKGROUND OF THE INVENTION

Certain types of fasteners include components designed to be retained by one of the members it is intended to secure. Being held in place, it is always in position to engage the mating component of the fastener in securing one part to another. An example is the fastener of U.S. Pat. No. 3,695,324 where a nut is held to one part for subsequent meshing with a stud associated with another part that is to be attached to the first. The nut is a component of an assembly that includes also a cage that holds the nut and a retention sleeve that fastens the cage to the part. The retention sleeve projects from the cage and has an outer end that is bent outwardly to form a flange used in holding the cage in place. Inwardly of that end is a straight knurl which enters an opening in the part to which the nut is attached. As it does so, the knurl cuts into the surface of the opening so that the retention sleeve, and hence the cage and nut, are prevented from rotation. In making the installation, it is necessary to force the retention sleeve into the opening so that the teeth of the knurl will cut into the surface of the opening. In addition, the outer end of the retention sleeve must be bent outwardly to form a flange.

Power tools may be used in installing such fasteners in factory production. However, these tools are relatively expensive and not readily movable. Hence, they are not suited for field service. Another type of installation tool is shown in U.S. Pat. Re. 27,928, this being a manually operated tool which can be transported for field use. However, this tool requires precision construction which causes it to be somewhat expensive. It incorporates levers to be gripped by hand resulting in a size larger than is desirable for some kinds of service. This tool also has the drawback of releasing the axial retention force on the fastener as the flange is formed, leading to the possibility that the flange may not securely and tightly hold the fastener to the workpiece.

BRIEF DESCRIPTION OF THE INVENTION

The present invention provides a very small, economically manufactured fastener installation tool which provides superior results in installing a fastener. It is a very simple device made up of three threaded components which mesh with each other for providing necessary movement upon advancement of the threads to first force the fastener into the opening in the workpiece and then retain the fastener in place while the flange is formed on the end of the retention sleeve of the fastener.

One threaded member of the tool of this invention is in the form of a sleeve with a threaded bore through it, and threads along most of its exterior surface. Wrenching surfaces are provided at one end for permitting this element to be rotated. Received within the sleeve is the elongated shank of a screw which has an outer end projecting beyond the sleeve. At the opposite end of the screw is a knurled head to enable the rotation of the screw. A third member, having external wrenching surfaces and a threaded bore, receives the external threads of the sleeve. An annular element at one end of the third member forms an abutment for engaging the surface of a workpiece.

The tool is used by threading the projecting end of the screw shank into the nut of the fastener assembly.

The third member of the tool is then advanced to the point that its abutment engaged the surface of the workpiece. Further advancement then causes axial movement of the threaded sleeve and hence of the screw, which forces the retention sleeve of the fastener into the opening so that its straight knurl cuts into the surface of the workpiece around the periphery of the opening. When the fastener has bottomed out against the opposite side of the workpiece, the third member of the tool remains in place as the threaded sleeve is advanced by rotating it relative to the nut member. One end of the threaded sleeve is provided with a die surface which enters the end of the tubular sleeve of the fastener, deflecting it outwardly and forcing it against the surface of the workpiece as the threaded sleeve is advanced. This takes place while the screw of the tool holds the fastener assembly against the opposite surface of the workpiece so that there is no tendency for a loose flange to be created. The tool then is removed readily by unthreading the screw of the tool from the nut of the fastener leaving the fastener in place ready for service.

BRIEF DESCRIPTION OF THE DRAWINGS

FIG. 1 is an exploded perspective view of the fastener installation tool of this invention;

FIG. 2 is a longitudinal sectional view showing the tool prepared for installing a fastener;

FIG. 3 is a view similar to FIG. 2 showing an intermediate stage of operation;

FIG. 4 is a view similar to FIGS. 2 and 3, but with the fastener fully installed; and FIG. 5 is an elevational view, partially in section, showing the installed fastener.

DETAILED DESCRIPTION OF THE PREFERRED EMBODIMENT

The fastener installation tool of this invention is made up of three components; a screw 10, sleeve 11 and pressure pad 12.

The screw 10 has a knurled head 13 from which projects an elongated threaded shank 14.

The sleeve 11 has a threaded cylindrical bore 15, as well as an external thread 16 that extends for most of its length. At one end of the sleeve 11 is a head 17 having a hexagonal wrenching surface. At the opposite end of the sleeve 11 is a radial surface 18, from the inner edge of which projects a frustoconical surface 19 that converges toward the outer end of the sleeve. The surfaces 18 and 19 are accurately machined, being the die surfaces that flare the outer end of the tubular part of the fastener being installed in a workpiece, as described below.

The pressure pad 12 resembles a nut, having a hexagonal wrenching surface 20 around its periphery and a threaded bore 21. A short tubular segment 22, of greater internal diameter than the threaded bore 21, projects from one end of the pressure pad. The tubular section 22 terminates at an annular radial abutment face 23.

When the installation tool is assembled, the shank 14 of the screw 10 is received within, and meshed with the thread of, the bore 15 of the sleeve 11. The shank 14 is of a length such that it projects beyond both ends of the sleeve 11. The thread 21 of the pressure pad 12 meshes with the external thread 16 of the sleeve 11, which is received within it. Prior to installation of a fastener, the sleeve 11 is retracted relative to the pressure pad 12 such that the die surfaces 18 and 19 of the sleeve are axially inwardly of the annular radial end face 23 of the pressure pad (see FIG. 2). The pressure pad 12 is shorter than the sleeve 11 and is spaced from the wrenching surface at the sleeve head 17.

In FIGS. 2, 3 and 4, the tool of this invention is illustrated in installing a fastener 25 in a workpiece 26, the fastener being a floating nut of the type shown in U.S. Pat. No. 3,695,324. This fastener includes a cage 27, having slotted opposed side flanges 28 and 29, and a central opening 30. A nut 31 has oppositely projecting base tabs 32 and 33 that extend into the slots of the side flanges 28 and 29. This holds the nut 31 to the cage 27, permitting limited floating movement, but precluding substantial rotation. Beneath the nut 31 is a retention sleeve 34 having a head 35 that extends into the slots of the side flanges 28 and 29 beneath the tabs 32 of the nut 31. Therefore, substantial relative rotation of the retention sleeve and the cage 27 is prevented. The sleeve 34, which is longer than the thickness of the workpiece 26, has a cylindrical periphery and a straight knurl 36 that extends a short distance from the sleeve head 35.

In order to attach the fastener 25 to the workpiece 26, it is necessary to force the retention sleeve 34 into the opening 38 into the workpiece so that the cage 27 of the fastener is brought to bear against one side 39 of the workpiece and the straight knurl 36 is caused to cut into the workpiece around the periphery of the opening. The teeth formed by the straight knurl 36 in that way preclude rotation of the fastener 25 relative to the workpiece 26. The installation also requires that the outer end portion of the retention sleeve 34 be flared outwardly and bent tightly down against a surface 40 of the workpiece 26, as may be seen in FIG. 5.

As an initial step in securing the fastener 25 to the workpiece 26, the end portion of the retention sleeve 34, beyond the knurl 36, is inserted into the opening 38 in the workpiece and the shank 14 of the screw 10 is meshed with the fastener nut 31 (see FIG. 2). At this point, the outer end of the straight knurl 36 is adjacent the surface 39 of the workpiece 26, but the knurl has not entered the opening 38.

Next, the pressure pad 12 of the tool is rotated relative to the sleeve 11 which advances the pressure pad axially and brings the end face 23 of the tubular projection 22 to bear against the side 40 of the workpiece 26 around and spaced outwardly from the opening 38. Upon continued rotation, the pressure pad 12 cannot be moved axially because of the engagement of its abutment surface 23 with the surface 40 of the workpiece 26. Consequently, the pressure pad 12 then produces a reaction that moves the sleeve 11 axially with respect to the pressure pad, away from its end face 23. Because the internal thread 15 of the sleeve 11 is meshed with the threaded shank 14 of the screw 10, the outward movement of the sleeve moves the screw with it. Therefore, as the screw 10 is moved axially to the left, as the device is illustrated, it pulls on the fastener nut 31, which it moves an equal distance. The fastener nut 31 reacts through the head 35 of the sleeve 34 to push the sleeve farther into the opening 38 in the workpiece 26. This continues until the cage 27 of the fastener 25 bottoms out against the surface 39 of the workpiece 26. When this occurs, the straight knurl 36 has been caused to cut into the workpiece 26 around the periphery of the opening 38 so that it is then capable of precluding rotation of the fastener 25 relative to the workpiece.

The next step is to advance the sleeve 11, to the right, as the tool is illustrated, by rotating it relative to the pressure pad 12. As a result, the tapered surface 19 at the end of the sleeve 11 enters the retention sleeve 34, engaging the inner end corner of the retention sleeve and deflecting it outwardly. Ultimately, the flat radial die surface 18 of the sleeve 11 is brought to bear against the deflected end portion of the retention sleeve 34, pressing it tightly against the surface 40 of the workpiece as seen in FIG. 4. This produces a flange 41 for cooperation with the cage 27 of the fastener to hold the nut 31 to the workpiece 26. A tight grip is achieved by the flange 41 because the tool holds the retention sleeve 34 within the opening 38 of the workpiece 26 during the time that the flange 41 is being formed.

After the installation, removal is easily effected by unthreading the screw 10 from the nut 31.

The foregoing detailed description is to be clearly understood as given by way of illustration and example only, the spirit and scope of this invention being limited solely by the appended claims.

We claim:

1. A fastener installation tool comprising a first member having internal threads and external threads, a second member having a threaded shank meshed with said internal threads of said first member, said threaded shank projecting beyond one end of said first member and being meshable with threads of a fastener having a nut and a projecting tubular portion, and a third member having internal threads, said external threads of said first member meshing with said internal threads of said third member, said third member having an abutment surface at one end thereof for engaging a workpiece upon rotation of said third member relative to said first member so as to advance said third member outwardly with respect to said one end of said first member, and thereafter producing an axial reaction on said first member for causing said first member to move said threaded shank of said second member axially so that said second member can force the tubular portion of such a fastener into an opening in the workpiece with the end of said tubular portion projecting therebeyond, said one end of said first member having a die surface for engaging the end of such a tubular portion when so forced into an opening in a workpiece upon rotation of said first member relative to said third member so as to cause advancement of said first member relative to said third member, for deflecting said end of said tubular portion against said workpiece for forming a retention flange.

2. A device as recited in claim 1 in which said third member includes an annular element of greater diameter than said first member at said external threads thereof, said abutment surface being a one end of said annular element.

3. A device as recited in claim 2 in which said abutment surface is a flat outer radial end face of said annular element.

4. A device as recited in claim 1 in which said third member has an external wrenching surface for facilitating rotation thereof.

5. A device as recited in claim 1 in which said first member is a sleeve having an external wrenching surface at one end portion, a bore therethrough having said internal thread thereof, and an exterior surface extending from adjacent said wrenching surface having said external thread thereof thereon.

6. A device as recited in claim 1 in which said second member is a screw having said elongated shank, said screw having a head exteriorly of said first member, said shank extending from said head at one end thereof.

7. A device as recited in claim 1 in which said die surface of said first member includes a tapered portion for entering the end of the tubular portion of a fastener and deflecting the same outwardly, and a radial surface at the inner end of said tapered portion for forcing such a tubular portion against the surface of a workpiece.

8. A fastener installation tool comprising a sleeve having a threaded bore, an external thread, a wrenching surface, and a die surface at one end, said die surface including a tapered portion adapted to enter and deflect the end of a retention sleeve of a fastener, a second member having an elongated threaded shank extending through said bore and meshed with the thread thereof, said shank extending beyond at least one end of said sleeve and being adapted to mesh with a thread of a fastener, and a third member having a threaded bore receiving said sleeve and meshed with said external thread thereof, said third member having a wrenching surface and an annular element at one end thereof, circumscribing and outwardly of said threaded bore thereof, said annular element having a radial outer abutment surface adapted to engage the surface of a workpiece upon axial advancement of said third member relative to said sleeve.

* * * * *